United States Patent [19]

Abe

[11] Patent Number: 4,813,327

[45] Date of Patent: Mar. 21, 1989

[54] MUSICAL TONE CONTROL SIGNAL GENERATING APPARATUS FOR ELECTRONIC MUSICAL INSTRUMENT

[75] Inventor: Yasunao Abe, Hamamatsu, Japan

[73] Assignee: Yamaha Corporation, Hamamatsu, Japan

[21] Appl. No.: 198,776

[22] Filed: May 25, 1988

[30] Foreign Application Priority Data

May 29, 1987 [JP] Japan ..... 62-136800
May 29, 1987 [JP] Japan ..... 62-136801

[51] Int. Cl.[4] ..... G10F 1/00; G10H 1/00
[52] U.S. Cl. ..... 84/1.03; 84/1.24
[58] Field of Search ..... 84/1.01, 1.03, 1.24

[56] References Cited

U.S. PATENT DOCUMENTS 4,179,971 12/1979 Takahashi et al. .
4,347,772 9/1982 Nishimoto .
4,653,374 3/1987 Iba ..... 84/1.01

FOREIGN PATENT DOCUMENTS 60-5203 2/1985 Japan .

*Primary Examiner*—Stanley J. Witkowski
*Attorney, Agent, or Firm*—Spensley Horn Jubas & Lubitz

[57] ABSTRACT

According to this invention, a musical tone control signal generating apparatus for an electronic musical instrument is provided. When a performer operates an automatic return type musical tone control operation element, the apparatus controls a generated musical tone according to the operation amount of the element. A possible offset amount generated when the musical tone control operation element is released and returned to an automatic return position, is detected, and operation element data is corrected based on the offset amount, so that a musical tone control signal is prevented from being offset.

11 Claims, 13 Drawing Sheets

MUSICAL TONE CONTROL SIGNAL GENERATING APPARATUS FOR ELECTRONIC MUSICAL INSTRUMENT

BACKGROUND OF THE INVENTION

The present invention relates to a musical tone control signal generating apparatus for an electronic musical instrument and, more particularly, to a musical tone control signal generating apparatus which can generate a musical tone control signal having a level corresponding to an operation position when a performer operates a musical tone control operation element.

In some musical tone control signal generating apparatuses of this type, a musical tone control signal is generated so as to provide a so-called pitch-bend effect to a musical tone using an automatic return type musical tone control operation element (U.S. Pat. No. 4,347,772).

For example, in a hand-held performance type electronic musical instrument 1 shown in FIG. 15, a keyboard unit 3 is arranged on a front surface portion of body portion 2 to extend in the right-and-left direction. A pitch-bend operation element 5 serving as a musical tone control operation element is arranged on a rear surface portion of a distal end portion of a neck portion 4 which projects to the left from the left end portion of the body portion 2. In a hand-held state in which a strap 6 attached to the body portion 2 is put on a performer's shoulder, he depresses a key at the keyboard unit 3 with a finger or thumb of his right hand, and pivots the pitch-bend operation element 5 from the rear surface side with the first, second, or third finger of his left hand while holding the neck portion with his left hand, thereby changing the pitch of the musical tone corresponding to the depressed key in accordance with a pivot position of the pitch-bend operation element 5.

The pitch-bend operation element 5 has the following structure. As shown in FIGS. 15 and 2, a wheel 11 partially projects from a panel surface of the neck portion 4. The performer rubs his finger on anti-slip notches 12 formed on the periphery of the wheel 11 to reciprocally pivot the wheel 11.

The pivot shaft of the wheel 11 is coupled to a pitch-bend volume 28 comprising a variable resistor, and a recess 13 is formed on the outer surface of the wheel 11. The recess 13 can be pivoted from a minimum operation position MIN toward a maximum operation position MAX, as indicated by an arrow a (called a forward operation), and can be pivoted from the maximum position MAX toward the minimum position MIN, as indicated by arrow b (called a reverse operation).

A return spring 11*a* is attached to the wheel 11. When the performer releases his finger from the wheel 11, the wheel 11 is automatically returned to a predetermined operation position by the return spring 11*a* (this automatic return position will be referred to as a middle operation position hereinafter).

The performer can easily confirm the automatic return operation of the wheel 11 since the recess 13 is returned to the predetermined middle operation position MID corresponding to the middle point between the maximum and minimum positions MAX and MIN.

When the pitch-bend effect is no longer required to be provided to a musical tone, the performer releases his finger from the pitch-bend operation element 5 so as to cause the wheel 11 to return to the middle operation position MID. Thus, a performance state for generating a musical tone with the pitch-bend effect can be immediately switched to a performance state without the pitch-bend effect. As a result, the pitch-bend effect can be provided as easy as possible.

However, when the pitch-bend operation element with the above arrangement is used, if the performer releases his finger from the wheel 11 while he pivots the wheel 11 to the position other than the middle operation position MID, the wheel 11 cannot often be accurately returned to the middle operation position MID.

The return spring for returning the wheel 11 to the middle operation position MID and a mechanical pivot mechanism portion of the wheel 11 inevitably fatigue as the pitch-bend operation element 5 is repeatedly used. For this reason, the wheel 11 cannot be correctly returned to the middle operation position MID.

In this state, the pitch of a key depressed at the keyboard unit 3 is offset higher or lower by an offset of the return position of the wheel 11 from the correct middle operation position MID.

When an electronic musical instrument is driven by a battery, if a power supply voltage varies, in particular, if a voltage is decreased and the operation element is located at a predetermined middle position, a signal derived from a variable resistor cooperating with the operation element cannot often have a correct signal level. In this case, if the operation element is used for pitch-bend, a pitch is offset higher or lower even if the element is located at the correct middle position.

SUMMARY OF THE INVENTION

It is therefore a principal object of the present invention to provide a musical tone control signal generating apparatus for an electronic musical instrument wherein even if an offset of a musical tone control operation element from a correct position occurs, the musical tone to be produced can be prevented from being influenced by the offset.

It is another object of the present invention to provide a musical tone control signal generating apparatus for an electronic musical instrument, especially, a portable electronic musical instrument using a battery, wherein even if a power supply voltage varies, a musical tone control signal produced by a musical tone control operation element can be prevented from being influenced by the variation.

It is still another object of the present invention to provide a musical tone control signal generating apparatus for an electronic musical instrument, wherein even if a musical tone control operation element is not returned to a correct middle position, a musical tone control signal to be generated can be prevented from being adversely affected.

In order to achieve the above objects, there is provided a musical tone control apparatus for an electronic musical instrument having an automatic return type musical tone control operation element, comprising a manual operation input mechanism attached to the musical instrument and having the operation element for controlling a musical tone signal to be generated, return means for automatically returning the operation element of the manual operation input mechanism to a predetermined return position, return position data generating means for generating return position data associated with the predetermined return position of the operation element of the manual operation input mechanism, operation element data generating means for generating operation element data corresponding to a position of the operation element of the manual input mechanism, non-operation time detection means for detecting that the operation element data is left unchanged for a predetermined period of time, deviation calculation means for, when the non-operation time detection means detects that the operation element data is left unchanged for the predetermined period of time, calculating a deviation of the operation element data from the data associated with the return position of the operation element of the manual operation input mechanism and generated by the return position data generating means, and means for producing musical tone control data based on at least an output from the deviation calculation means and the operation element data.

When a musical tone control operation element (5) is automatically returned to an automatic return position together with an offset when a performer releases an operation, a non-operation time detection means (23, SP21, SP22, SP23, SP24, SP25, SP28, SP21) confirms that operation element data DATA is left unchanged for a predetermined period of time. Thereafter, the operation element data DATA representing an operation position of the musical tone control operation element located at the automatic return position is stored in a correction data generating means (23, SP26), and is sent to correction means (23, SP29, SP30) as correction data POFFST.

In this case, the correction means (23, SP29, SP30) corrects the operation element data DATA, so that an offset operation position is set to be a new automatic return position. The correction means then outputs the corrected operation element data DATA as musical tone control data WHEELP.

Even if the musical tone control operation element is offset, a musical tone control signal can be prevented from being offset.

DESCRIPTION OF THE PREFERRED EMBODIMENT

An embodiment of the present invention will be described hereinafter in detail with reference to the accompanying drawings. In this embodiment, the present invention is applied to the hand-held performance type electronic musical instrument 1 shown in FIG. 15 so as to produce a musical tone control signal for providing a pitch-bend effect to a musical tone.

Figure 1:
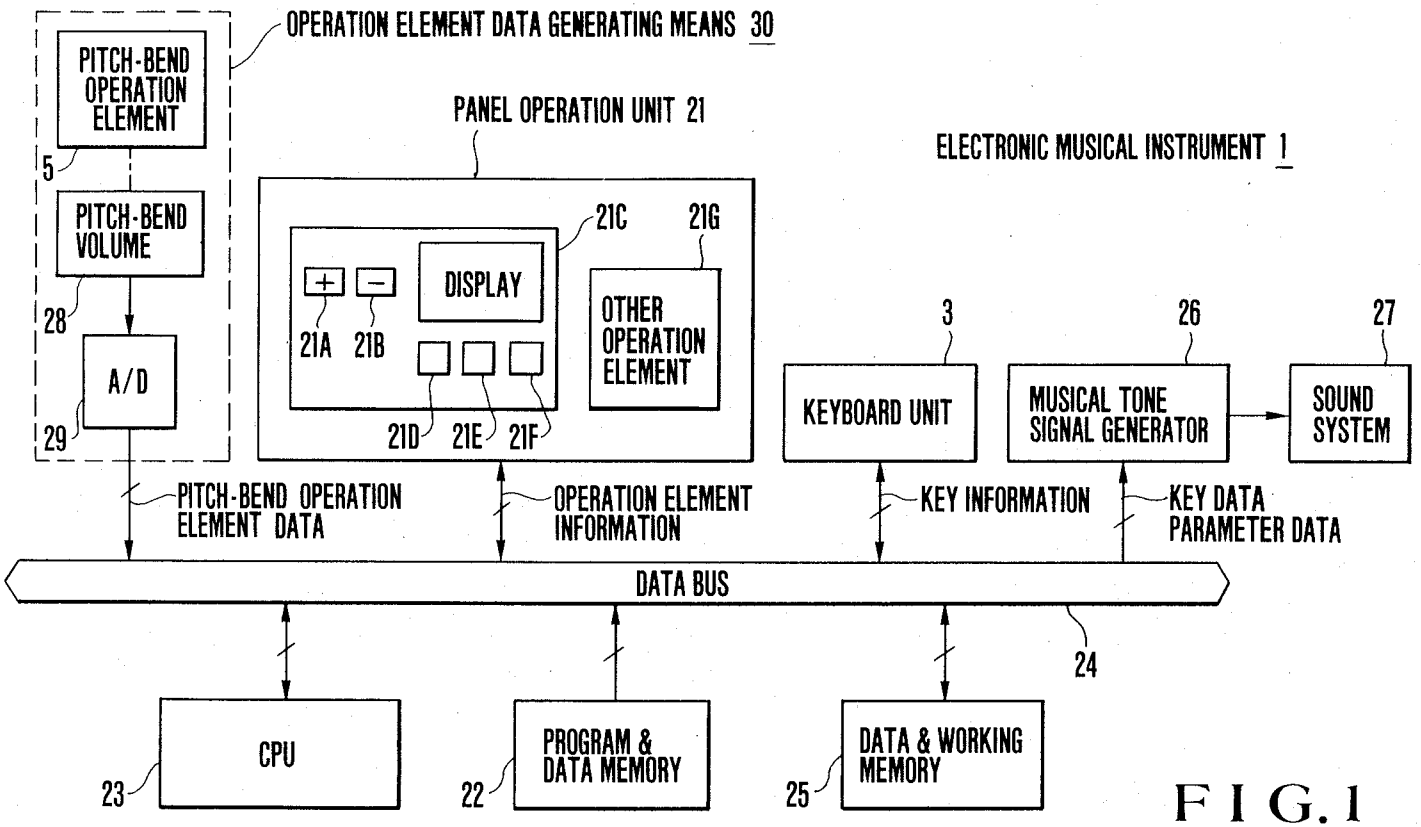
FIG. 1 is a block diagram showing an embodiment of an electronic musical instrument using a musical tone control signal generating apparatus according to the present invention.
Figure 2:
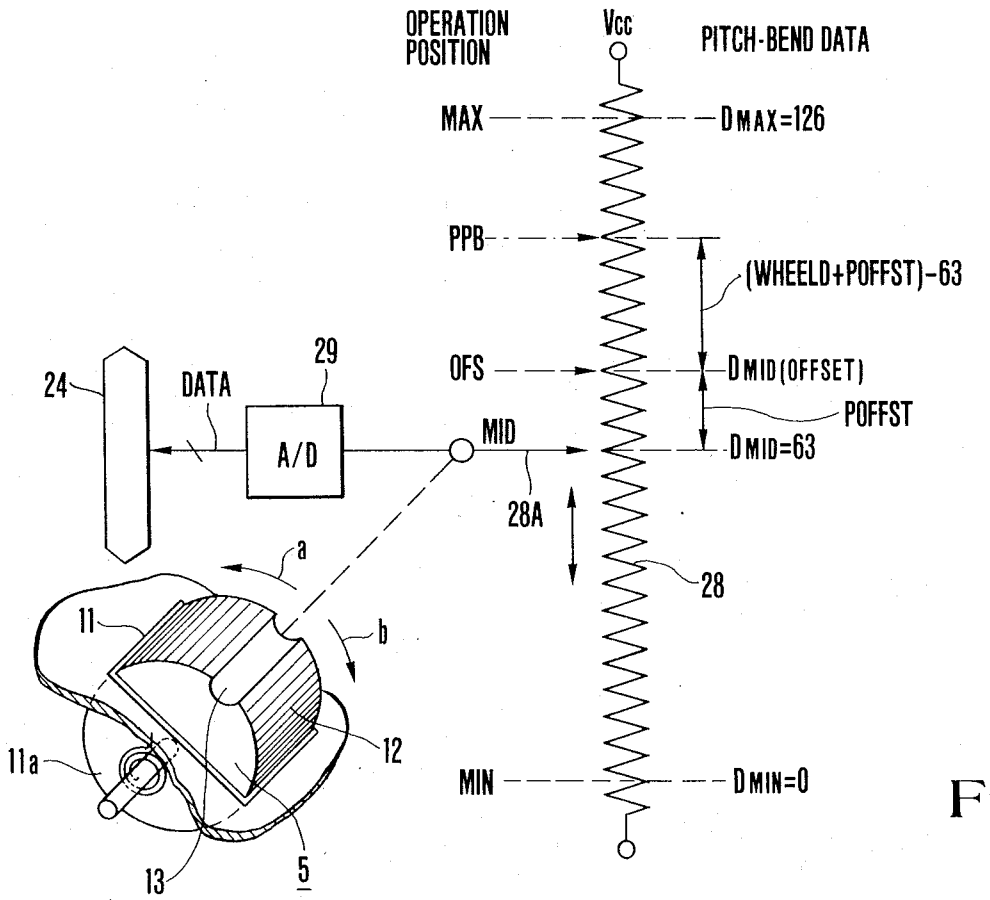
FIG. 2 is a schematic diagram showing a detailed arrangement of an operation element data generating means shown in FIG. 1.
Figure 15:
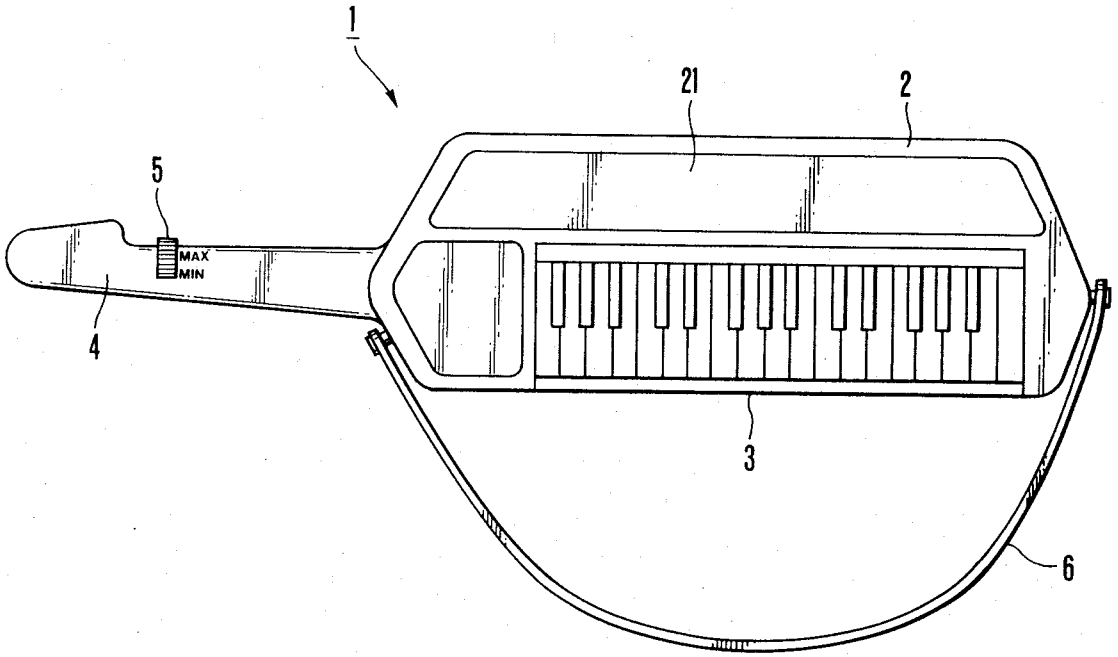
FIG. 15 is a plan view showing an outer appearance of an electronic musical instrument.

Note that the same reference numerals in FIGS. 1 and 2 denote the same parts as in FIG. 15. In the electronic musical instrument 1 shown in FIGS. 1 and 2, key information KIN input from a keyboard unit 3 and operation element information PIN input from panel operation unit 21 are fetched in a data & working memory 25 comprising a RAM by a central processing unit (CPU) 23 for executing program data stored in a program & data memory 22 comprising a ROM through a data bus 24.

The CPU 23 executes predetermined data processing for these input information, and supplies obtained key data KD and parameter data PRD to a musical tone generator (TG) 26. The TG 26 generates a musical tone signal designated by the key data KD and the parameter data PRD, and sends it to a sound system 27. The sound system 27 converts the musical tone signal into a musical tone.

A pitch-bend operation element 5 is mechanically coupled to a variable operation element 28A of a pitch-bend volume 28, as shown in FIG. 2. A voltage output corresponding to an operation position of the variable operation element 28A is converted to 7-bit pitch-bend operation element data DATA by an analog-to-digital (A/D) converter 29.

The pitch-bend operation element 5, the pitch-bend volume 28, and the A/D converter 29 constitute an operation element data generating means 30 for generating the pitch-bend operation element data DATA in accordance with an operation of a performer.

In this embodiment, when the operation of the pitch-bend operation element 5 is released, the operation element 5 is returned to a middle position upon operation of a return spring 11*a*, so that the variable operation element 28A is automatically returned to a middle operation position MID between maximum and minimum positions MAX and MIN regardless of a rotating direction of the operation element 5.

When the variable operation element 28A is located at the middle operation position MID, the A/D converter 29 (FIG. 2) outputs middle operation position data $D_{MID}$ (=63 (decimal number)) as the pitch-bend operation element data DATA. When the variable operation element 28A is moved to the maximum operation position MAX, the converter 29 outputs maximum operation position data $D_{MAX}$ (126 (decimal number)) as the pitch-bend data DATA. Furthermore, when the variable operation element 28A is moved to the minimum position MIN, converter 29 outputs minimum operation position data $D_{MIN}$ (=0 (decimal number)) as the pitch-bend operation element data DATA.

In contrast to this, when the variable operation element 28A is automatically returned and is offset to an offset operation position OFS from the correct middle operation position MID, the pitch-bend volume 28 outputs offset position data $D_{MID(OFFSET)}$ as the pitch-bend operation element data DATA. Thus, the pitch-bend operation element data DATA representing that a new middle operation position is offset from the correct middle operation position data $D_{MID}$ (=63) by an amount corresponding to pitch offset data POFFST (=$D_{MID(OFFSET)}$) is written by the CPU 23 in the data & working memory 25.

The panel operation unit 21 is disposed on the rear surface portion of the body portion 2 (FIG. 15) adjacent to the keyboard unit 3. The panel operation unit 21 includes an up switch 21A, a down switch 21B, a display 21C, a tempo setting operation switch 21D, a transposition setting operation switch 21E, a tuning setting operation switch 21F, and other operation elements 21G (e.g., a tone color selection switch, a tone volume designation switch, and a rhythm selection switch).

In this embodiment, the up and down switches 21A and 21B are commonly used when tempo for automatic performance is set by the tempo setting operation switch 21D, when transposition data is input by the transposition setting operation switch 21E, when a reference pitch is finely adjusted by tuning setting operation switch 21F, and when a possible change width and a change direction are set.

Figure 3:
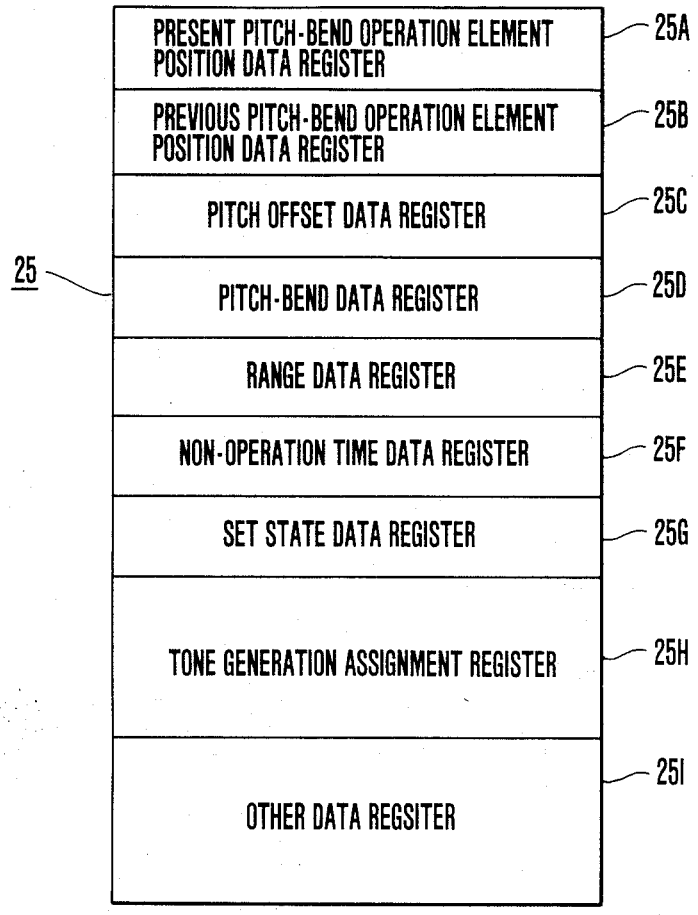
FIG. 3 shows a format of a data & working memory.

The data & working memory 25 has various registers, as shown in FIG. 3.

A present pitch-bend operation position data register 25A stores present pitch-bend operation position data WHEELN representing a present operation position of the pitch-bend operation element 5. In practice, the data WHEELN is fetched such that the CPU 23 repetitively scans the pitch-bend operation element data DATA supplied from the operation element data generating means 30 onto the data bus 24 for a predetermined cycle.

A previous pitch-bend operation position data register 25B stores previous pitch-bend operation position data WHEELD corresponding to the pitch-bend operation element data DATA which was fetched in the present pitch-bend operation position data register 25A during the previous scan operation while the CPU 23 repetitively scans to sequentially fetch the present pitch-bend operation element data DATA.

A pitch offset data register 25C stores pitch offset data POFFST representing an offset amount from the correct middle operation position MID at the pitch-bend volume 28 when a finger is released after the pitch-bend operation element 5 is operated toward the maximum or minimum operation positions MAX or MIN.

A pitch-bend data register 25D stores corrected pitch-bend data WHEELP (=WHEELN+POFFST) obtained by correcting the value of the pitch-bend operation element data DATA obtained from the pitch-bend volume 28, i.e., the present pitch-bend operation position data WHEELN, based on the pitch offset data POFFST. The corrected pitch-bend data WHEELP is used as fundamental data in the TG 26 for forming pitch-bend control data for a musical tone to be generated presently.

A range data register 25E stores correction coefficient data BRANGE representing a possible change width and a change direction of pitch-bend. The correction coefficient data BRANGE consists of a sign data portion representing a pitch change direction of a musical tone signal by "+" or "−", and a coefficient value data portion representing a dynamic range of pitch-bend to be provided by coefficient values "1" to "12".

In order to form a control signal for an actual musical tone, one of change widths "0" to "126" of the pitch-bend operation element data DATA obtained from the pitch-bend volume 28 is converted to the corresponding one of change amounts "−63" to "0" or "0" to "+63" having the value "63" of the correct middle operation position as the center. Thereafter, the converted amount is selectively multiplied with a corresponding one of the contents "+1" to "+12" or "−1" to "−12" of the correction coefficient data BRANGE.

Figure 4:
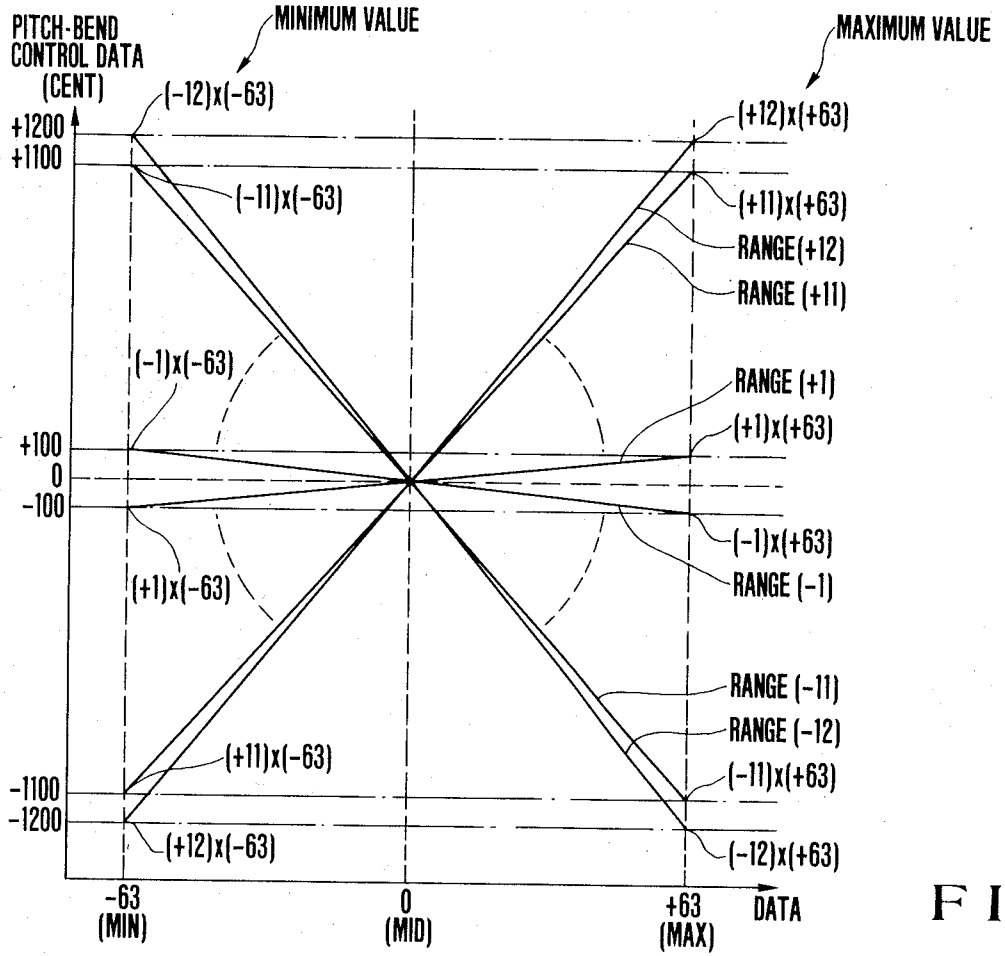
FIG. 4 is a graph for explaining correction coefficient data BRANGE.

As a result of multiplication, data which changes with a positive inclination from minimum values RMIN=(+12)×(−63), (+11)×(=63), . . . , (+1)×(−63) toward maximum values RMAX=(+12)×(+63), (+11)×(+63), . . . , (+1)×(+63), and data which changes with a negative inclination from the lower limit values RMIN=(−1)×(−63), . . . , (−11)×(−63), and (−12)×(−63) toward the maximum values RMAX=(−1)×(+63), . . . , (−11)×(+63), and (−12)×(+63) when the pitch-bend operation element 5 is operated to increase the value of pitch-bend operation element data DATA, can be obtained, as indicated by conversion lines RANGE (+12), RANGE (+11), . . . , RANGE (+1), and RANGE (−1), . . . , RANGE (−11), and RANGE (−12) in FIG. 4.

If data in units of 100 cents, i.e., "+1200" cents, "+1100" cents, . . . , "+100" cents, "−100" cents, . . . , "−1100" cents, and "−1200" cents are assigned as pitch-bend control data to the maximum values RMAX=(+12)×(+63), (+11)×(+63), . . . , (+1)×(+63), (−1)×(+63), . . . , (−11)×(+63), and (−12)×(+63) of the conversion lines RANGE (+12), RANGE (+11), . . . , RANGE (+1), and RANGE (−1), . . . , RANGE (−11), and RANGE (−12), when the pitch-bend operation element 5 is operated from the minimum operation position MIN to the maximum operation position MAX through the middle operation element position MID, one of "+12" to "+1" and "−1" to "−12" can be selected as the correction coefficient data BRANGE, so that pitch-bend control data which changes (from "−1200" cents to "+1200" cents), (from "−100" cents to "+100" cents), (from "+100" cents to "−100" cents), and (from "+1200" cents to "−1200" cents) can be generated.

As can be seen from the conversion lines RANGE (+12) to RANGE (+1) and RANGE (−1) to RANGE (−12) in FIG. 4, if the sign of the sign data portion of the correction coefficient data BRANGE is selected to be "+", the absolute value of the cent value of the pitch-bend control data can be controlled to be increased while the pitch-bend operation element 5 is operated from the minimum position MIN to the maximum position MAX (this operation is called a forward operation). In contrast to this, if the sign of the sign data portion is selected to be "−", the absolute value of the cent value of the pitch-bend control data can be controlled to be increased while the pitch-bend operation element 5 is operated from the maximum operation position MAX to the minimum operation position MIN (this operation is called a reverse operation).

Therefore, assume that the sign of the sin data portion of the correction coefficient data BRANGE is set such that the absolute value of the pitch-bend control data is increased when the performer operates the pitch-bend operation element 5 of the electronic musical instrument 1 (FIG. 15) forward from the rear surface side to the front surface side. In this case, when the performer wants to operate the pitch-bend operation element 5 in a reverse direction from the front surface side to the rear surface side to obtain the same effect as described above, the sign of the sign data portion can be inverted. Thus, the absolute value of the pitch-bend control data can be similarly increased by the reverse operation.

A non-operation time data register 25F stores non-operation time data WCNT as determination reference data for determining whether or not the pitch-bend operation element 5 is operated during a predetermined time interval from when the pitch-bend operation element 5 is left non-operated. The non-operation time data WCNT is used for the following processing. That is, when the pitch-bend operation element 5 is left non-operated for a time interval represented by the non-operation time data WCNT after it is automatically returned to the middle operation position, the automatic return position of the pitch-bend operation element 5 of the non-operated state is set as a new middle operation position.

A set state data register 25G stores set state data STATE representing data for which the up and down switches 21A and 21B, and the display 21C of the panel operation unit 21 are currently used. In this embodiment, when the set state data STATE respectively correspond to set numbers "0", "1", and "2", the tempo setting state, the transposition setting state, and the tuning setting state respectively using the setting operation switches 21D, 21E, and 21F are set.

A tone generation assignment register 25H stores frequency data FDATA of keys presently depressed at the keyboard unit 3 for musical tones of a plurality of (N) channels, which can be simultaneously generated by the TG 26.

A data register 25I stores other data ANDATA associated with, e.g., a tone color, tempo, transposition, tuning, and the like.

Figure 5:
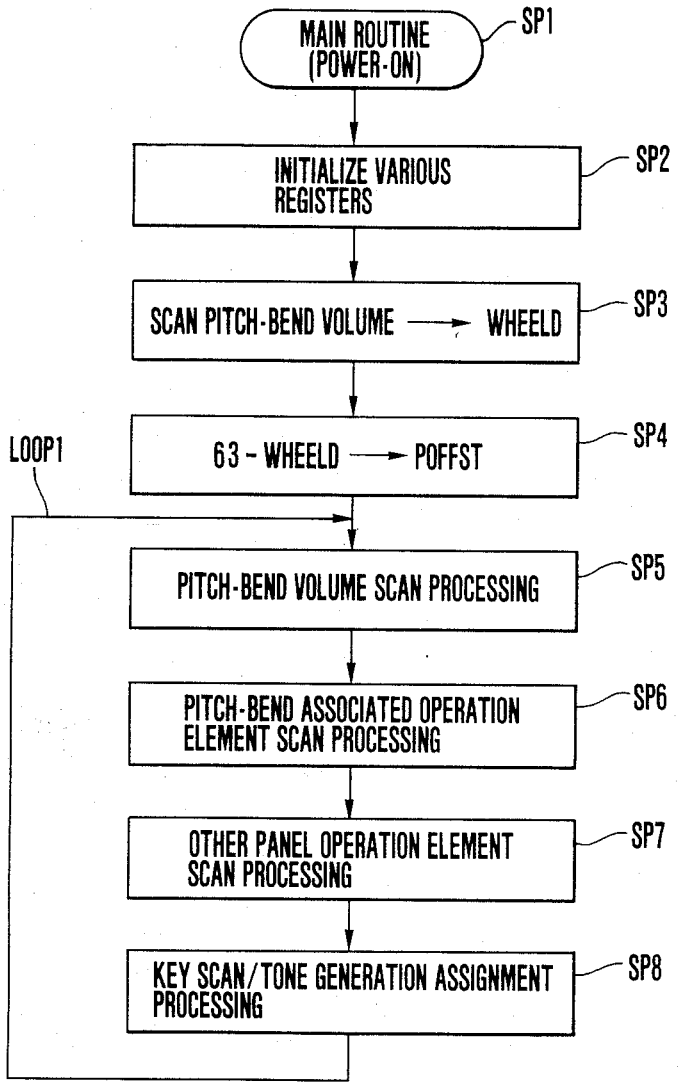
FIG. 5 is a flow chart showing a main routine.

With the above arrangement, the electronic musical instrument 1 causes the CPU 23 to be operated when a power switch is turned on (i.e., power-on), thus starting the main routine of a musical tone generation processing program from step SP1 of FIG. 5.

In this case, the CPU 23 initializes the various registers including the data & working memory 25 (FIG. 3) in step SP2, and scans the pitch-bend operation element data DATA output from the pitch-bend volume 28 in step SP3 to fetch it in the previous pitch-bend operation position data register 25B as the previous pitch-bend operation position data WHEELD.

Thereafter, the flow advances to step SP4, and the CPU 23 writes, in the pitch offset data register 25C, difference data from the correct middle operation position data $D_{MID}$ (=63) using the previous pitch-bend operation position data WHEELD as the pitch offset data POFFST (63−WHEELD).

The processing in steps SP3 and SP4 is to initially set, in the pitch offset data register 25, the difference data from the correct middle operation position data $D_{MID}$ using the pitch-bend operation element data DATA representing the position of the pitch-bend operation element 5 as the pitch offset data POFFST when the pitch-bend operation element 5 is not yet operated after power-on.

In this manner, the initial condition setting processing is completed. The flow then advances to step SP5, and the CPU 23 executes scan processing of the pitch-bend volume 28. In this processing, the CPU 23 executes the subroutine shown in FIG. 6 so as to set a present automatic return position as a new middle operation position when the pitch-bend operation element 5 is left non-operated for a predetermined period of time. In addition, in this processing, the pitch-bend effect is provided to a musical tone control signal to be sent to the TG 26 when the pitch-bend operation element 5 is operated.

The flow then advances to step SP6, and the CPU 23 executes scan processing of the pitch-bend associated operation elements. In this processing, the CPU 23 executes the subroutines shown in FIGS. 7, 8, and 9 for the tempo setting operation switch 21D, the transposition setting operation switch 21E, and tuning setting operation switch 21F which use the up and down switches 21A and 21B and the display 21C commonly with the pitch-bend processing.

Figure 7:
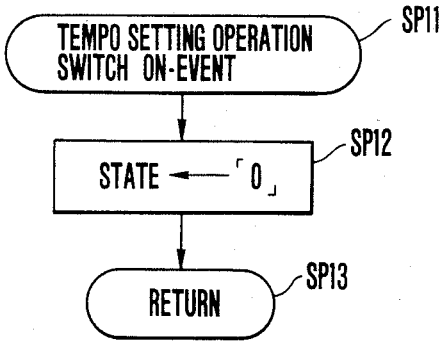
FIGS. 7, 8, and 9 are flow charts respectively showing data processing sequences of a tempo setting operation switch 21D, a transposition setting operation switch 21E, and tuning setting operation switch 21F.

If an on-event of the tempo setting operation switch 21D is detected in step SP11 in FIG. 7, the flow advances to step SP12, and the CPU 23 writes the set state data STATE="0" in the set state data register 25G. Thereafter, the flow returns to the main routine from step SP13.

Figure 8:
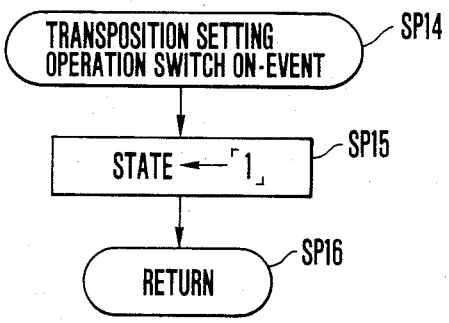

If an on-event of the transposition setting operation switch 21E is detected in step SP14 in FIG. 8, the flow advances to step SP15, and the CPU 23 writes the set state data STATE="1" in the set state data register 25G. Thereafter, the flow returns to the main routine from step SP16.

Figure 9:
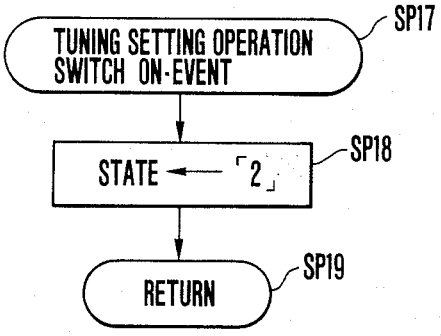

If an on-event of the tuning setting operation switch 21F is detected in step SP17 in FIG. 9, the flow advances to step SP18, and the CPU 23 writes the set state data STATE="2" in the set state data register 25G. Thereafter, the flow returns to the main routine from step SP19.

Subsequently, the CPU 21 scans the outputs from the other operation elements 21G of the panel operation unit 21 in step SP7. The flow advances to step SP8, and the CPU 23 scans a key output depressed at the keyboard unit 3 to fetch key data. Thereafter, the CPU 23 assigns a tone generation channel to the key data, and writes it in the tone generation assignment register 25H as the frequency data FDATA.

Thereafter, the flow returns to step SP5, and the CPU 23 repeats processing of a loop LOOP1 consisting of steps SP5, SP6, SP7, SP8, and SP5. Each time the performer makes a new operation, the CPU 23 performs this operation, and fetches the processed data in the data & working memory 25.

Figure 6:
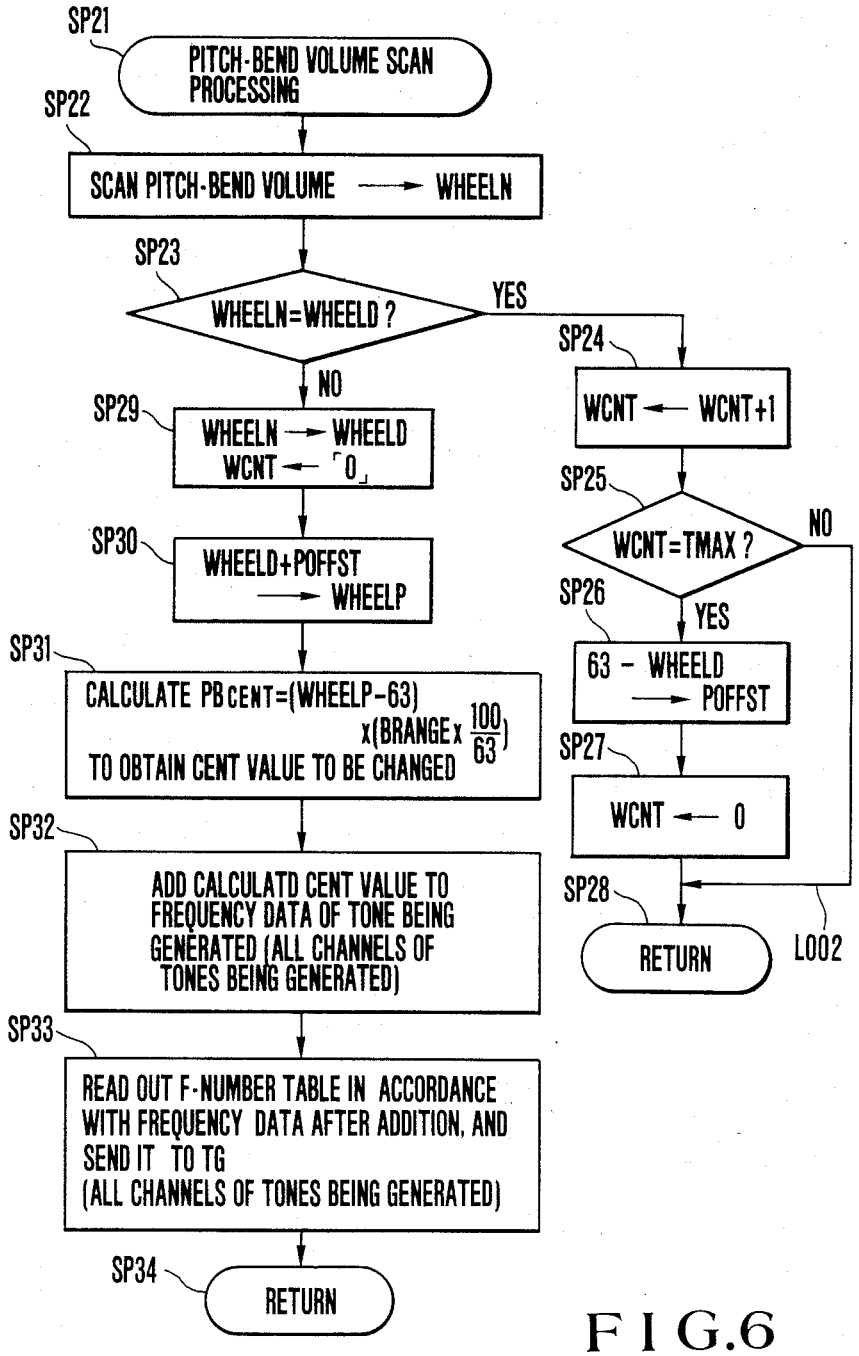
FIG. 6 is a flow chart showing a pitch-bend volume scan processing subroutine.

The CPU 23 enters the pitch-bend volume scan processing subroutine from step SP21 in FIG. 6. In step SP22, the CPU 23 scans the pitch-bend operation element data DATA of the pitch-bend volume 28, and writes it in the present pitch-bend operation position data register 25A as the present pitch-bend operation position data WHEELN.

In step SP23, the CPU 23 reads out the data WHEELN and WHEELD from the present and previous pitch-bend operation position data registers 25A and 25B, and checks if these data are equal to each other. If NO in step SP23, this means that the pitch-bent operation element 5 is operated. However, if YES in step SP23, this means that the pitch-bent operation element 5 is not operated.

If YES in step SP23, the flow advances to step SP24, and the CPU 23 counts a time for which the pitch-bend operation element 5 is left non-operated, i.e., a non-operation time. If the non-operation time has reached a predetermined time period, the CPU 23 enters the pitch offset calculation processing for calculating the present pitch offset data POFFST of the pitch-bend operation element 5.

Note that the automatic return position (FIG. 2) to which the pitch-bend operation element 5 is returned when the performer releases his finger therefrom does not always coincide with the correct middle operation position MID, and may often be an offset operation position OFS. Thus, the CPU 23 first executes the pitch offset calculation processing to calculate the pitch offset data POFFST.

More specifically, the CPU 23 increments the data WCNT of the non-operation time data register 25F by "+1" in step SP24. The flow advances to step SP25, and the CPU 23 checks if the "+1" incremented non-operation time data WCNT is equal to predetermined reference time data TMAX (e.g., 1 sec). If NO in step SP25, the flow returns to the main routine from step SP28.

In this case, since the CPU 23 repeats the processing of the loop LOOP1 (FIG. 5), it repeats processing of loop LOOP2 consisting of steps SP21, SP22, SP23, SP24, SP25, SP28, and SP21, accordingly. In this manner, the non-operation time data WCNT in the non-operation time data register 25F is increased by a period of a calculation clock of the CPU 23.

When the non-operation time data WCNT becomes equal to the reference time data TMAX, YES is obtained in step SP25, and the flow advances to step SP26. The CPU 23 subtracts the data WHEELD in the previous pitch-bend operation position data register 25B from the correct middle operation position data $D_{MID}$ (=63) (FIG. 2), thereby obtaining the pitch offset data POFFST (=63−WHEELD). The CPU 23 writes the data POFFST in the pitch offset data register 25C, and the flow then advances to step SP27. In step SP27, the CPU 23 resets the data WCNT in the non-operation time data register 25F to "0".

When the present operation position of the pitch-bend operation element 5 which is left non-operated after it was automatically returned becomes an offset position OFS, pitch offset data POFFST of the offset position OFS from the correct middle operation position data $D_{MID}$ (=63) is stored in the pitch offset data register 25C.

Thereafter, the flow returns to the main routine from step SP28, and the CPU 23 executes step SP21 again. As long as the pitch-bend operation element 5 is left non-operated, YES is kept obtained in step SP23. Thus, the count operation of the non-operation time data WCNT is repeated by the loop LOOP2. In this manner, the CPU 23 checks the pitch offset data POFFST of the non-operated pitch-bend operation element 5 every predetermined time interval represented by the predetermined reference tim data TMAX (i.e., 1 sec), thereby updating the pitch offset data register 25C.

In this state, when the performer operates the pitch-bend operation element 5 and hence, the pitch-bend operation element data DATA obtained from the pitch-bend volume 28 is changed, the CPU 23 fetches the changed data in the present pitch-bend operation position data register 25A in step SP22. Therefore, since the value of the present pitch-bend operation position data WHEELN becomes different from that of the previous pitch-bend operation position data WHEELD, the CPU 23 obtains NO in step SP23.

The flow then advances to step SP29, and the CPU 23 rewrites the data WHEELN stored in the present pitch-bend operation position data register 25A as previous pitch-bend operation position data WHEELD, and resets the non-operation time data WCNT in the non-operation time data register 25F to be "0".

In this manner, when the pitch-bend operation element 5 is operated, the CPU 23 stores the previous pitch-bend operation position data WHEELD in the previous pitch-bend operation position data register 25B, and resets the non-operation time data register 25F to a standby state capable of restarting counting.

The flow advances to step SP30, and the CPU 23 reads out the data WHEELD and POFFST from the previous pitch-bend operation position data register 25B and the pitch offset data register 25C, and adds them to each other. Thereafter, the CPU 23 writes the sum data in the pitch-bend data register 25D as the pitch-bend data WHEELP (=WHEELD+POFFST).

Thus, the corrected pitch-bend data WHEELP (=WHEELD+POFFST) stored in the pitch-bend register 25D is obtained as follows. Reference pitch-bend operation element data DATA which changes within the range between minimum position data $D_{MIN}$ (=0) and maximum position data $D_{MAX}$ (=126) to have the middle operation position data $D_{MID}$ (=63) (FIG. 2) as the center is shifted by the pitch offset data POFFST and converted to the pitch-bend data WHEELP which changes about the offset middle operation position $D_{MID(OFFSET)}$.

The flow then advances to step SP31, and the CPU 23 calculates pitch change amount data $PB_{CENT}$ to be provided to a pitch of a musical tone in accordance with an operation of the pitch-bend operation element 5 using the following equation:

$$PB_{CENT} = (WHEELP - 63) \times \left( BRANGE \times \frac{100}{63} \right) \quad (1)$$

Thus, the pitch change amount data $PB_{CENT}$ represented by a cent value can be obtained.

In equation (1), the right-hand side term (WHEELP−63) is to obtain data which takes a positive value within the range between the offset middle operation position data $D_{MID(OFFSET)}$ as the center and the maximum operation position data $D_{MAX}$ and takes a negative value within the range between the offset middle operation position data $D_{MID(OFFSET)}$ and the minimum operation position data $D_{MIN}$.

The right-hand side term (BRANGE×100/63) in equation (1) represents the number of cents per unit data of the range from a new middle operation position OFS to the maximum or minimum operation position MAX or MIN based on the correction coefficient data BRANGE stored in the range data register 25E.

For example, if the correction coefficient value BRANGE is "+1", a change width of pitch-bend when it is changed from the middle operation position MID to the maximum operation position MAX is "+100" cents (e.g., corresponding to a halftone), as described in FIG. 4 as the conversion line RANGE (+1). Within the range between the middle operation position MID and the minimum operation position MIN, a pitch change corresponds to "−100" cents.

In contrast to this, when the correction coefficient data BRANGE is set to be BRANGE="−12", the range between the middle operation position MID and the maximum operation position MAX corresponds to a change amount of "−1200" cents, and the range between the middle operation position MID and the minimum operation position MIN corresponds to a change amount of "+1200" cents.

In this manner, the pitch change amount data $PB_{CENT}$ in equation (1) represents an operation amount from the new middle operation position OFS (FIG. 2) after correction to a present operation position PPB of the pitch-bend operation element 5 in units of cents.

In step SP32, the CPU 23 adds the pitch change amount data $PB_{CENT}$ to frequency data of a tone which is being produced, thereby generating frequency data provided with the pitch-bend effect. In step SP33, the CPU 23 reads out an F-number table stored in the program & data memory 22 based on the sum frequency data, and sends the F-number data to the TG 26.

The processing in steps SP32 and SP33 is executed for all the channels which are generating tones. When the processing is completed, the CPU 23 returns to the main routine from step SP34.

Figure 10:
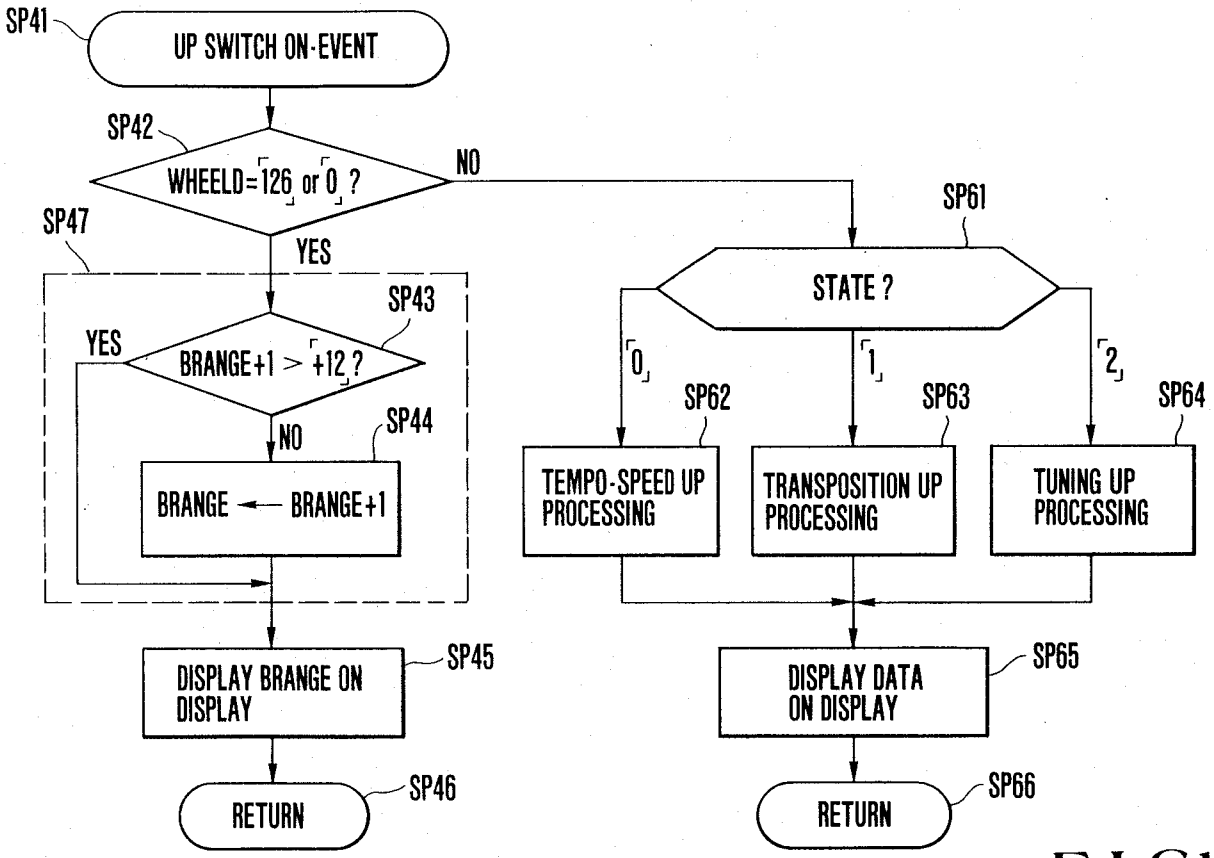
FIGS. 10 and 11 are flow charts showing processing sequences of input data from an up switch 21A and a down switch 21B.
Figure 11:
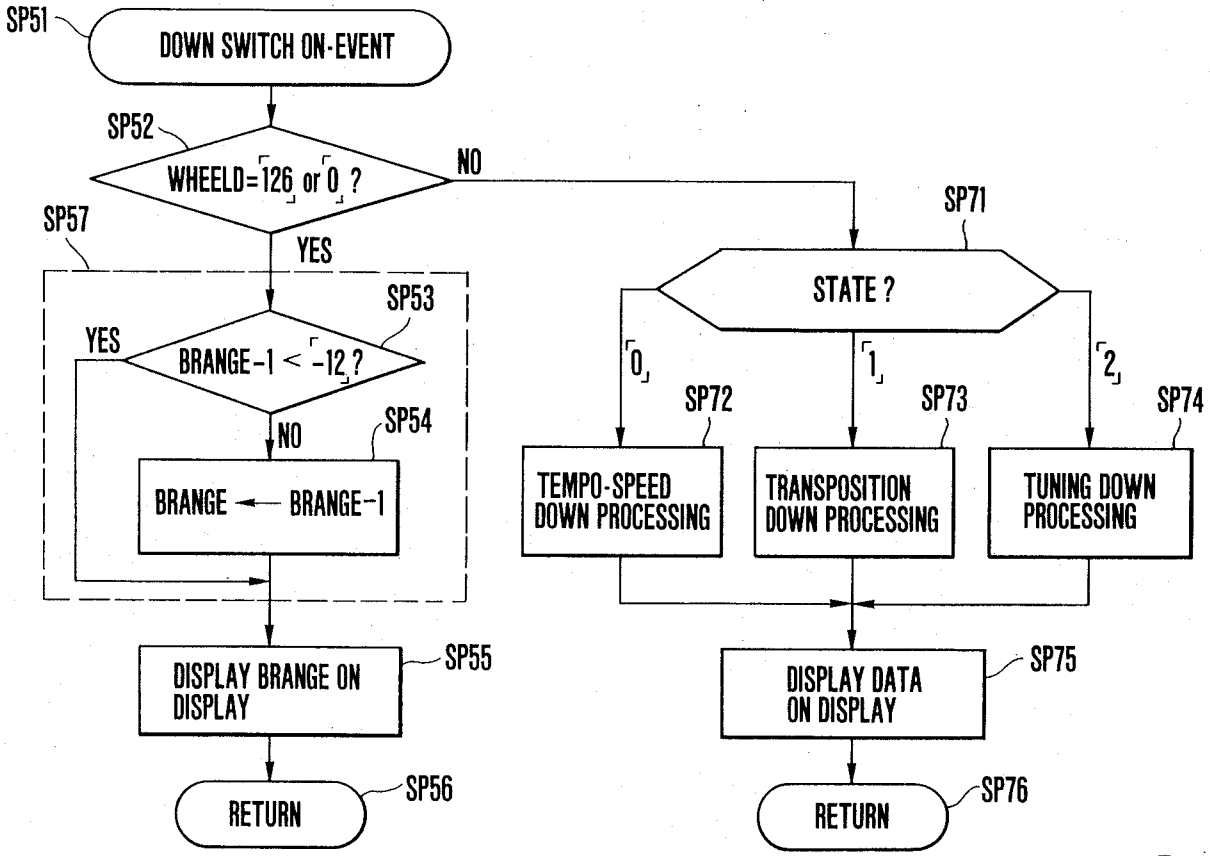

Write access or updating of the correction coefficient data BRANGE in the range data register 25E is executed by the CPU 23 in accordance with the processing sequence shown in FIGS. 10 or 11 when the up or down switch 21A or 21B at the panel operation unit 21 is operated.

When the value of the correction coefficient data BRANGE is to be increased, the performer repetitively turns on the up switch 21A a plurality of times as needed. In this case, the CPU 23 enters the up switch on-event processing program from step SP41 in FIG. 10. In step SP42, the CPU 23 checks if the data WHEELD in the previous pitch-operation position data register 25B has reached a maximum value "126" or a minimum value "0".

If YES in step SP42, the flow advances to step SP43, and the CPU 23 checks if the correction coefficient data "BRANGE+1" exceeds maximum data "+12". If NO in step SP43, the flow advances to step SP44, and the CPU 23 adds "+1" to the correction coefficient data BRANGE, and writes the sum data in the range data register 25E.

Thereafter, the flow advances to step SP45, and the CPU 23 causes the display 21C to display the correction coefficient data BRANGE, so that the performer can visually confirm the updated data. Thereafter, the flow returns to the main routine from step SP46.

However, if YES in step SP43, this means that the value of the correction coefficient data BRANGE stored in the range data register 25E has already reached the maximum data "+12", and a "+1" addition can no longer be performed. In this case, the flow jumps to step SP45, and causes the display 21C to display the correction coefficient data BRANGE before the "+1" addition, thereby signaling this to the performer.

In contrast to this, when the value of the correction coefficient data BRANGE stored in the range data register 25E is to be decreased, the performer operates the down switch 21B.

The CPU 23 enters the down switch on-event processing program in step SP51 in FIG. 11, and checks in step SP52 if the data WHEELD stored in the previous pitch-bend operation position data register 25B has reached a maximum value "126" or a minimum value "0". If YES in step SP52, the flow advances to step SP53 and it is checked if the correction coefficient data "BRANGE−1" becomes smaller than the minimum data "−12". If NO in step SP53, the correction coefficient data BRANGE is decremented by one in step SP54, and the obtained data is written in the range data register 25E.

The flow advances to step SP55, and the CPU 23 causes the display 21C to display the correction coefficient data BRANGE decremented by one. The flow returns to the main routine in step SP56.

However, if YES in step SP53, the CPU 23 does not decrement the correction coefficient data BRANGE by one, and the flow jumps to step SP55. Thus, the CPU 23 signals to the performer that the present correction coefficient data BRANGE is minimum value data.

Thus, the value of the correction coefficient data BRANGE in the range data register 25E can be changed step by step by operating the up or down switch 21A or 21B after the pitch-bend operation element 5 is operated to the maximum or minimum operation position MAX or MIN.

As a result, when the pitch-bend operation element 5 is variably operated from the minimum operation position MIN to the maximum operation position MAX, an amount capable of varying a pitch of a musical tone (i.e., a possible change width of pitch-bend) can be easily changed by varying the correction coefficient data BRANGE in the range data register 25E, as described with reference to the conversion lines RANGE (+12) to RANGE (+1) and RANGE (−1) to RANGE (−12) shown in FIG. 4.

The correction coefficient data is subjected to addition/subtraction in accordance with the up switch on-event processing program (FIG. 10) or the down switch on-event processing program (FIG. 11) under the condition that the pitch-bend operation element 5 is operated to the maximum or minimum operation position MAX or MIN. Thus, a special-purpose switch for selecting pitch-bend need not be provided on the panel operation unit 21, and the overall arrangement can be simplified accordingly.

When the pitch-bend operation element 5 is not operated to the maximum or minimum operation position MAX or MIN in the up or down switch on-event processing program (FIGS. 10 or 11), the CPU 23 executes a setting processing mode other than setting of the correction coefficient data BRANGE.

When the up switch 21A is operated, the CPU 23 enters the up switch on-event processing program from step SP41 in FIG. 10, and NO is obtained in step SP42. Then, the flow advances to step SP61. It is checked in step SP61 if the data STATE in the data & working memory 25 corresponds to "0", "1", or "2". If the data STATE is "0", the flow advances to step SP62, and tempo speed-up processing is executed; if "1", the flow advances to step SP63, and transposition up processing is executed; and if "2", the flow advances to step SP64, and tuning up processing is executed.

In these processing steps SP62, SP63, and SP64, after it is determined that the data is not a maximum value, the data is incremented by "+1" in the same manner as in steps SP43 and SP44, as indicated by step SP47 in the processing sequence of the correction coefficient data BRANGE.

These data are stored as portions of data ANDATA in the data register 25I of the data & working memory 25.

After the processing operations of steps SP62, SP63, and SP64 are completed, the CPU 23 causes the display 21C to display the "+1" incremented data, so that the performer confirms this, and the flow returns to the main routine from step SP66.

In contrast to this, when the performer operates the down switch 21B, the CPU 23 enters the down switch on-event processing program from step SP51 in FIG. 11, and determines in step SP52 that the previous pitch-bend operation position data WHEELD is not a maximum value "126" or a minimum value "0". Thereafter, the flow advances to step SP71 to check the content of data STATE in the set condition data register 25G. If the data STATE is "0", tempo speed-down processing is executed in step SP72; if "1", transposition down processing is executed in step SP73; and if "2", tuning down processing is executed in step SP74. In these processing operations, after it is determined that the data does not become smaller than the minimum value "0", "−1" subtraction processing is performed, as described in steps SP53 and SP54 included in step SP57.

After the above processing is completed, the flow advances to step SP75, and the CPU 23 causes the display 21C to display the corresponding processing result. Thereafter, the flow returns to the main routine from step SP76.

With the above arrangement, after the performer releases his finger from the pitch-bend operation element 5 and the operation element 5 is automatically returned to the middle operation position, if the performer does not operate the operation element 5 for a predetermined period of time (e.g., 1 sec), the CPU 23 calculates pitch offset data POFFST representing a deviation of the present middle operation position of the pitch-bend operation element 5 from the correct middle operation position in accordance with the loop of steps SP21, SP22, SP23, SP24, SP25, SP26, SP27, and SP28 (FIG. 6). Thereafter, the CPU 23 corrects the value of the previous pitch-bend operation position data WHEELD using the pitch offset data POFFST in accordance with the loop of steps SP21, SP22, SP23, SP29, SP30, SP31, SP32, SP33, and SP34 (FIG. 6). Thus, data obtained from the present middle operation position is used as the new middle operation position data, and thereafter, pitch-bend control data according to the operation position of the pitch-bend operation element 5 can be produced.

Therefore, even when the pitch-bend operation element 5 cannot be returned to the correct middle operation position due to the mechanical fatigue, a possibility of offsetting a pitch of a musical tone to be generated can be effectively avoided.

With the above arrangement, in, e.g., a battery-driven portable electronic musical instrument, even if a power supply voltage varies, the pitch of a musical tone to be generated can be free from variations.

According to the above embodiment, the correction coefficient data BRANGE is constituted by "+" and "−" sign portion data and coefficient value portion data. The correction coefficient data BRANGE of the above content is multiplied with the operation position data WHEELD to produce pitch-bend control data. Thus, if the operation direction of the pitch-bend operation element 5 is reversed in accordance with the content of the sign portion data of the correction coefficient data BRANGE, the pitch-bend of a musical tone can be increased or decreased in the same direction.

Therefore, assume that the hand-held electronic musical instrument 1 shown in FIG. 1 is placed on a desk, and the performer pivots the pitch-bend operation element 5 forward (from the maximum operation position MAX toward the minimum operation position MIN) with his finger of the left hand while performing the keys at the keyboard unit on the front surface side. In this case, if the sign portion data of the correction coefficient data BRANGE is set to be an opposite sign, e.g., "−", to a case of hand-held performance, a change in pitch of a musical tone can be controlled to match with operation feeling of the hand-held performance, as needed.

The present invention is not limited to such a way of use. If the hand-held or desk-top performance is similarly made, the sign of the sign portion data of the correction coefficient data BRANGE and the value of the coefficient value data portion are selected in accordance with the performer's favor, so that musical tones can be pitch-bend controlled in a variety of pitch-bend operation modes.

Modifications of the present invention will be described below.

(1) In the above embodiment, as a means for generating pitch-bend operation element data DATA, an analog voltage corresponding to an operation position of the pitch-bend operation element 5 is generated using the pitch-bend volume 28 comprising a variable resistor, and the analog voltage is converted to a digital value by the A/D converter 29. Instead, a means for directly generating digital data corresponding to the operation position of the pitch-bend operation element 5 may be employed, and the same effect as described above can be provided.

(2) In the above embodiment, the present invention is applied to the arrangement for providing a pitch-bend effect to a musical tone. However, the present invention is not limited to this. For example, the present invention may be widely applied to an arrangement wherein a control signal for controlling a musical tone in accordance with an operation amount of a musical tone control operation element is produced as in a case wherein control signals for tone color and tone volume of a musical tone, and a frequency and amplitude of a modulation signal, and the like are produced.

(3) In the above embodiment, in order to obtain an effect control signal corresponding to an operation position of a pitch-bend volume, the operation position is converted to a cent value, and the cent value is then converted to F-number data (steps SP31, SP32, SP33 in FIG. 6). However, the present invention is not limited to this. For example, control data representing a frequency ratio may be directly produced in correspondence with the operation position of an operation element.

(4) In the above embodiment, in order to obtain a musical tone control signal corresponding to an operation position of a musical tone control operation element, this processing is realized by a software processing program. Instead, this processing may be realized by special-purpose hardware.

(5) In the above embodiment, when the correction coefficient data is set in the range data register 25E, in both cases wherein the pitch-bend volume 28 is at the maximum value "126" corresponding to the maximum operation position MAX and the minimum value "0" corresponding to the minimum operation position MIN, the value RMAX corresponding to the maximum operation position MAX is set as the correction coefficient data BRANGE (FIG. 4). In this case, however, a value RMIN corresponding to the minimum operation position MIN may be set. Alternatively, when the pitch-bend volume is operated to the maximum operation position MAX, the maximum value RMAX may be set, and when it is operated to the minimum operation position MIN, the minimum value RMIN may be set.

When the minimum value RMIN is set, the value of the sign portion data of the correction coefficient data BRANGE can be inverted to a case wherein the maximum value is set.

(6) In the above embodiment as a means for setting the correction coefficient data BRANGE, the up or down switch 21A or 21B is used. However, an input means is not limited to this, but may comprise a ten-key pad, a special-purpose volume, or the like.

(7) In the above embodiment, when the pitch-bend operation element 5 is operated from the minimum operation position MIN to the maximum operation position MAX through the middle operation position MID, the conversion curves RANGE (+12) to RANGE (+1) and RANGE (−1) to RANGE (−12) represented by single straight lines are set, as shown in FIG. 4, so that the operation position data from the minimum operation position MIN to the middle operation position MID and the operation position data from the middle operation position MID to the maximum operation position MAX are simultaneously set. Instead, another arrangement may be employed so that a conversion curve from the middle operation position MID to the minimum operation position MIN and a conversion curve from the middle operation position MID to the maximum operation position MAX can be independently set.

(8) In the above embodiment, as a means for setting the correction coefficient data BRANGE of pitch-bend, it is determined based on the pitch-bend operation element data DATA output from the pitch-bend volume 28 that the correction coefficient data BRANGE setting mode is set when the condition for causing the performer to set the maximum or minimum operation position MAX or MIN is satisfied. Instead, a pitch-bend setting operation switch may be provided as well as the tempo setting operation switch 21D, the transposition setting operation switch 21E, and tuning setting operation switch 21F.

(9) In the above embodiment, in order to control a change direction of a musical tone, the up and down switches 21A and 21B are operated to input "+" and "−" data. Instead, a sign change switch may be separately arranged to obtain the same effect as described above.

(10) In the above embodiment, the non-operation time data WCNT for determining that the middle operation position data must be rewritten is selected to be a fixed value (e.g., 1 sec). However, the non-operation time may vary.

(11) In the above embodiment, when the operation of the pitch-bend operation element 5 is released, the operation element 5 is automatically returned to the middle operation position MID as the middle point between the maximum and minimum operation positions MAX and MIN. However, the automatic return position is not limited to the middle point, but may be any position between the maximum and minimum operation positions MAX and MIN.

Figure 12:
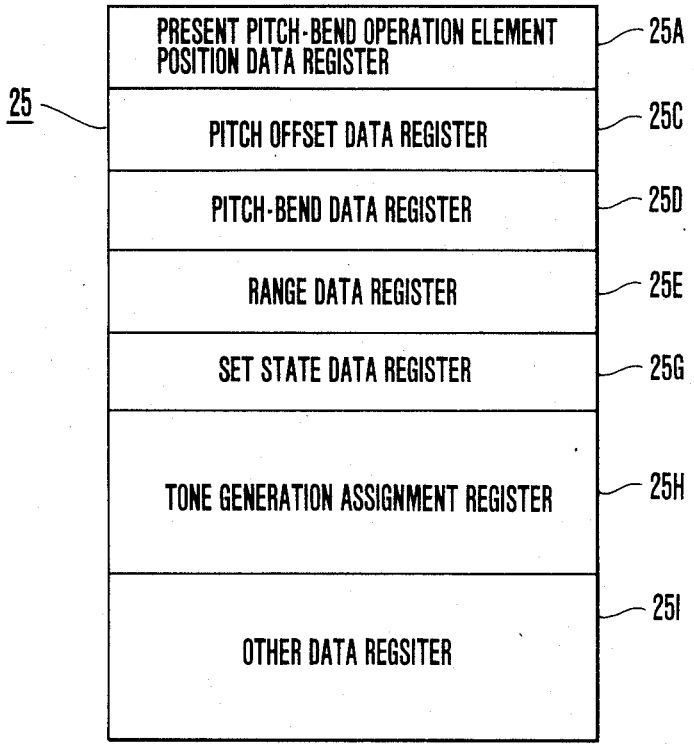
FIG. 12 shows a format of a data & working memory according to a modification of the embodiment.
Figure 13:
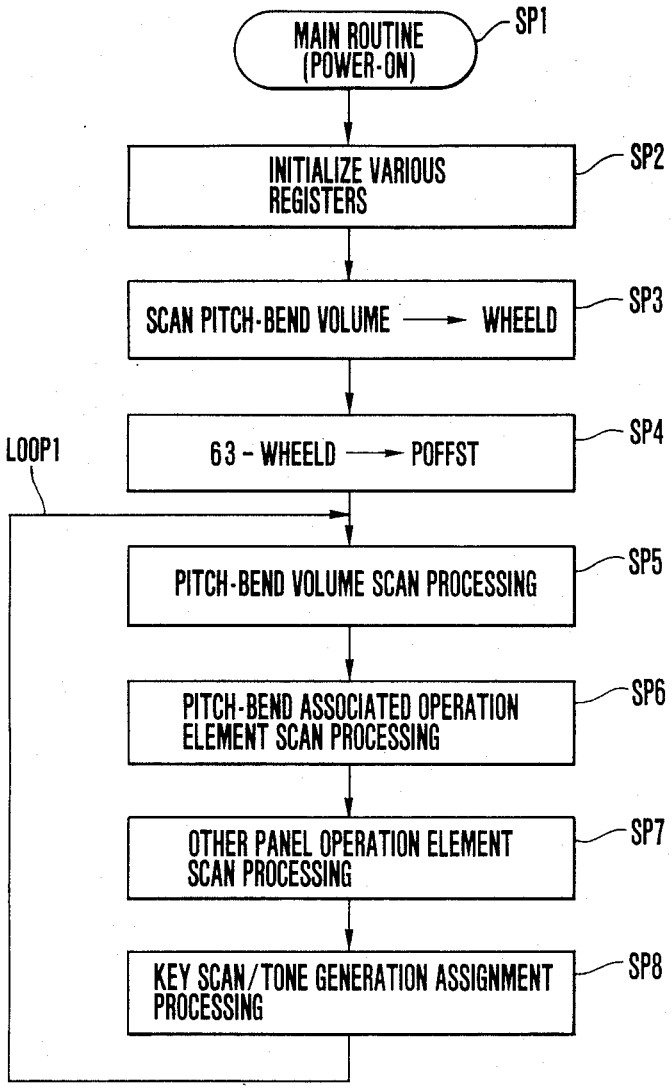
FIG. 13 is a flow chart showing a main routine of the modification.
Figure 14:
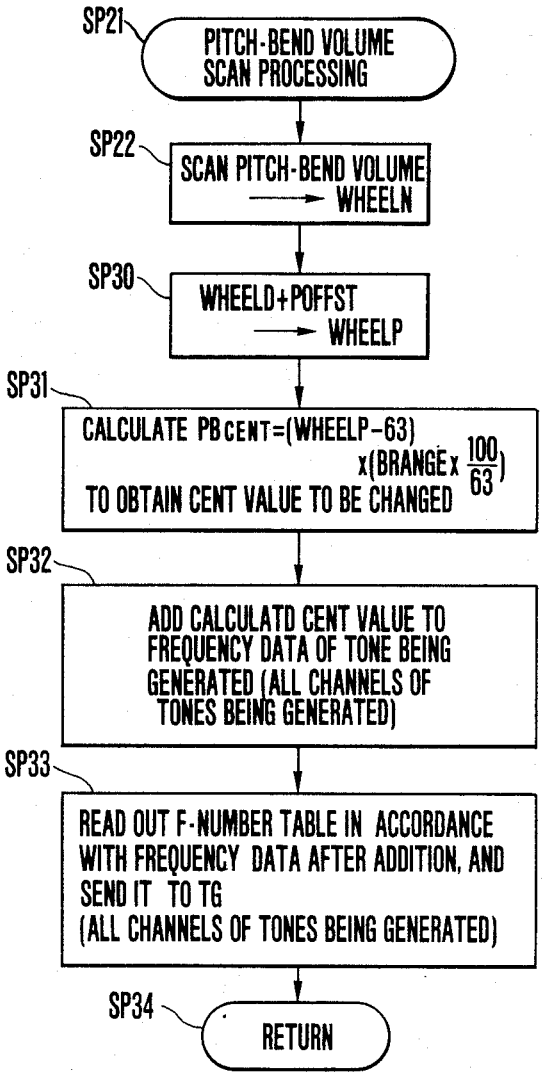
FIG. 14 is a flow chart showing a pitch-bend volume scan processing subroutine of the modification.

In the above embodiment, the offset data is generated based on data obtained when the operation element data is left unchanged for a predetermined period of time. However, the position of the operation element upon power-on is set to be a predetermined return position, and a deviation of this position from the correct position can be used as an offset amount. In this case, the format of a data & working memory is as shown in FIG. 12, and corresponds to FIG. 3 in the above embodiment. A difference between FIGS. 3 and 12 is that the previous pitch-bend operation position data register 25B and the non-operation time data register 25F in FIG. 3 are omitted. The flow charts therefor are as shown in FIGS. 13 and 14, and correspond to FIGS. 5 and 6 in the above embodiment. A difference between FIGS. 5 and 13 is that the scan result of the pitch-bend volume is stored not in the previous pitch-bend operation position data register 25B but in the present pitch-bend operation position data register 25A, and in FIG. 13, a value WHEELN stored in the register 25A is subtracted from the correct middle operation position data $D_{MID}=63$ in step SP4 to obtain pitch offset data POFFST. In this embodiment, the middle position data $D_{MID}$ is obtained in this manner. Therefore, in the pitch-bend volume data processing routine shown in FIG. 14 corresponding to FIG. 6, steps SP23 to SP29 in FIG. 6 are omitted, and in step SP30 in FIG. 14, the value WHEELN stored in the register 25A is added to the pitch offset data POFFST and the sum is stored in the pitch-bend data register 25D. In this manner, the number of processing steps can be reduced compared to the above-mentioned embodiment.

According to still another modification, a value obtained by scanning the pitch-bend volume is stored in the register 25A as present pitch-bend operation position data, and a value obtained by subtracting "63" from the content WHEELN of the register 25A can be used as a deviation for control data each time a musical tone control signal is necessary.

According to the present invention as described above, when a musical tone control operation element is left non-operated for a predetermined non-operation time after it is returned to an automatic return position, operation data is corrected such that present automatic return position data becomes new automatic return position data. Thus, if the operation element is returned to the automatic return position to be offset from a correct position, a musical tone control signal which does not cause an offset of a control amount of a musical tone can be reliably generated.

What is claimed is:

1. A musical tone control apparatus for an electronic musical instrument having an automatic return type musical tone control operation element, comprising:

a manual operation input mechanism attached to said musical instrument and having said operation element for controlling a musical tone signal to be generated;

return means for automatically returning said operation element of said manual operation input mechanism to a predetermined return position;

return position data generating means for generating return position data associated with the predetermined return position of said operation element of said manual operation input mechanism;

operation element data generating means for generating operation element data corresponding to a position of said operation element of said manual input mechanism;

non-operation time detection means for detecting that the operation element data is left unchanged for a predetermined period of time;

deviation calculation means for, when said non-operation time detection means detects that the operation element data is left unchanged for the predetermined period of time, calculating a deviation of the operation element data from the data associated with the return position of said operation element of said manual operation input mechanism and generated by said return position data generating means; and means for producing musical tone control data based on at least an output from said deviation calculation means and the operation element data.

2. An apparatus according to claim 1, wherein the predetermined return position of said operation element is set at a middle point between maximum and minimum operation positions.

3. An apparatus according to claim 2, further comprising:

designation means for selectively designating a possible change width and a change direction of a musical tone control signal; and musical tone control signal generating means for generating a musical tone control signal which is increased/decreased in correspondence with a polarity determined by an operation direction of said operation element and the possible change width.

4. A musical tone control signal generating apparatus for an electronic musical instrument, comprising:

a musical tone control operation element which is automatically returned to a predetermined automatic return position when a performer releases said operation element;

operation element data generating means for generating operation element data corresponding to an operation position of said operation element;

non-operation time detection means for detecting that said operation element data is left unchanged for a predetermined period of time;

correction data generating means for producing correction data based on the operation element data when said non-operation time detection means is operated; and musical tone control data generating means for correcting operation element data obtained thereafter in accordance with the correction data to produce musical tone control data, wherein a musical tone to be generated is controlled by the musical tone control data.

5. An apparatus according to claim 4, wherein the predetermined return position of said operation element is set at a middle point between maximum and minimum operation positions.

6. An apparatus according to claim 5, further comprising:

designation means for selectively designating a possible change width and a change direction of a musical tone control signal; and musical tone control signal generating means for generating a musical tone control signal which is increased/decreased in correspondence with a polarity determined by an operation direction of said operation element and the possible change width.

7. A musical tone control signal generating apparatus for an electronic musical instrument, comprising:

a musical tone control operation element which is automatically returned to a predetermined automatic return position when a performer releases said operation element;

operation element data generating means for generating operation element data corresponding to an operation position of said operation element;

non-operation time detection means for detecting that said operation element data is left unchanged for a predetermined period of time;

correction means for producing correction data based on a position of said operation element upon power-on of said instrument; and musical tone control data generating means for correcting operation element data obtained thereafter in accordance with the correction data to produce musical tone control data, wherein a musical tone to be generated is controlled by the musical tone control data.

8. An apparatus according to claim 7, wherein the predetermined return position of said operation element is set at a middle point between maximum and minimum operation positions.

9. An apparatus according to claim 8, further comprising:

designation means for selectively designating a possible change width and a change direction of a musical tone control signal; and musical tone control signal generating means for generating a musical tone control signal which is increased/decreased in correspondence with a polarity determined by an operation direction of said operation element and the possible change width.

10. A musical tone control signal generating apparatus for an electronic musical instrument, comprising:

a musical tone control operation element which is operated in a first direction from a minimum operation position to a maximum operation position or in a second direction from the maximum operation position to the minimum operation position by a performer;

designation means for designating a possible change width and a change direction of a musical tone control signal upon an operation of the performer; and musical tone control signal generating means for, when said operation element is operated in the first or second direction in correspondence with the operation position of said operation element, generating a musical tone control signal which is increased or decreased in correspondence with the change direction and possible change width designated by said designation means, wherein a musical tone to be generated is controlled by the musical tone control data.

11. An apparatus according to claim 10, wherein said designation means has means for providing a positive or negative sign to a value of the musical tone control signal which is output in correspondence with at least one of the maximum and minimum operation positions, the sign determining the change direction of the musical tone signal.

* * * * *